US010080276B2

(12) United States Patent
Hartman et al.

(10) Patent No.: US 10,080,276 B2
(45) Date of Patent: Sep. 18, 2018

(54) IRRADIATION APPARATUS WITH LIMITED SWIVEL ROTATOR

(71) Applicant: Rad Source Technologies, Inc., Suwanee, GA (US)

(72) Inventors: William Hartman, Boca Raton, FL (US); John Orza, Sugar Hill, GA (US)

(73) Assignee: Rad Source Technologies, Inc., Buford, GA (US)

( * ) Notice: Subject to any disclaimer, the term of this patent is extended or adjusted under 35 U.S.C. 154(b) by 235 days.

(21) Appl. No.: 15/270,776

(22) Filed: Sep. 20, 2016

(65) Prior Publication Data

US 2017/0118829 A1 Apr. 27, 2017

Related U.S. Application Data

(60) Provisional application No. 62/245,691, filed on Oct. 23, 2015.

(51) Int. Cl.

| | |
|---|---|
| ***G21K 5/10*** | (2006.01) |
| ***H05G 1/02*** | (2006.01) |
| ***G21K 5/08*** | (2006.01) |

(52) U.S. Cl.

CPC ..... *H05G 1/02* (2013.01); *G21K 5/08* (2013.01); *G21K 5/10* (2013.01)

(58) Field of Classification Search

CPC .. H05G 1/00; H05G 1/02; G21K 5/00; G21K 5/08; G21K 5/10; A61L 2/00; A61L 2/082

USPC ..... 378/57, 64, 69, 119, 195, 196, 197, 208; 250/454.11; 426/240

See application file for complete search history.

(56) References Cited

U.S. PATENT DOCUMENTS

| | | | | |
|---|---|---|---|---|
| 6,212,255 | B1 | 4/2001 | Kirk | |
| 6,389,099 | B1 | 5/2002 | Gueorguiev | |
| 6,614,876 | B1 | 9/2003 | Kirk | |
| 7,346,147 | B2 | 3/2008 | Kirk et al. | |
| 7,515,686 | B2 * | 4/2009 | Kirk | G21K 5/08 378/57 |
| 2007/0025515 | A1 | 2/2007 | Kirk et al. | |

* cited by examiner

*Primary Examiner* — Jurie Yun

(74) *Attorney, Agent, or Firm* — Akerman LLP; Mammen (Roy) P. Zachariah, Jr.

(57) ABSTRACT

An irradiation apparatus with a limited swivel rotator includes a drive ring and at least one mount affixed thereto. The drive ring has a defined drive axis of rotation being configured to rotate about a source container, like an X-ray tube. The mounts are affixed to the drive ring. Each of the mounts is configured to mount a material holder to the drive ring for rotating the material holder about the source container. The limited swivel rotator is in communication with each of the mounts and is configured to maintain a radial planetary position of the mounts and the material holders mounted thereto to maintain an initial horizontal orientation of the mounts and the material holders mounted thereto on the drive ring as the mounts and the material holders mounted thereto are moved around the source container by the drive ring.

20 Claims, 6 Drawing Sheets

IRRADIATION APPARATUS WITH LIMITED SWIVEL ROTATOR

CROSS-REFERENCE TO RELATED APPLICATIONS

This application claims benefit to U.S. Provisional Patent Application No. 62/245,691, filed on Oct. 23, 2016, which is incorporated by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The instant disclosure generally relates to an irradiation apparatus. More specifically, the instant disclosure relates to an apparatus with a limited swivel rotator for irradiation of material utilizing radiation, like X-rays.

Description of the Related Art

The present disclosure generally relates to a more efficient apparatus and method for irradiation of material utilizing X-rays. While the disclosure will be described for use for medical irradiation, the disclosure is also applicable to various fields in which efficient irradiation of material is in demand including industrial irradiation and/or irradiation of food products. For example, the FDA has approved the use of ionization radiation from three different sources of irradiation that produce essentially equivalent pathogen reduction. The three approved sources are gamma rays from radioactive cobalt-60 or cesium-137, linear accelerators producing electron energies less than ten million volts, and X-Rays generated from equipment energies of less than five million volts. Each of said types of sources are in present use throughout the USA for the irradiation of food products.

The present application is related to U.S. Pat. Nos. 6,212,255 and 6,614,876, which patents are incorporated herein by reference. The present application is also related to U.S. Pat. No. 6,389,099 titled "Irradiation System and Method Using X-Ray and Gamma-Ray Reflector" and to U.S. Pat. No. 7,346,147 titled "X-ray Tube With Cylindrical Anode", which are also incorporated herein by reference. The present disclosure utilizes a radiation source, like X-Rays, of irradiation that is believed to have a number of advantages over the other two types of sources that need not be discussed in detail herein. Such other sources are generally much larger in size and scale, are much higher in initial cost, and pose higher safety hazards normally requiring more sophisticated irradiation protection.

U.S. Pat. No. 7,515,686 discloses one specific system wherein the X-ray tube with a cylindrical anode has an extremely beneficial use. U.S. Pat. No. 7,515,686 is also incorporated herein by reference. More specifically, U.S. Pat. No. 7,515,686 discloses an apparatus for providing X-ray energy to irradiate a product, where the apparatus includes an elongated X-ray tube that provides the X-ray energy (see U.S. Pat. No. 7,346,147), a wheel structure that rotates about the X-ray tube, and a plurality of containers for the product to be irradiated mounted on the wheel structure. Each container is mounted to the wheel structure by a cradle with swingable mounting elements, i.e. the mounting elements have free rotation. The mounting elements are offset from the center of the cradles thereby allowing the cradles to utilize gravity to maintain an initial horizontal orientation as the cradles are moved in a circle around the X-ray tube by the wheel structure, similar to that of a well-known Ferris wheel. See Claim 1 and Column 2, Line 60 through Column 3, Line 3.

One problem that has been discovered with this free rotation mounting elements of the containers, that utilize gravity like a Ferris wheel for maintaining the initial horizontal orientation, is that they allow for swinging or swiveling of the containers. This swinging or swiveling of the containers permits the distance from the container to the X-ray tube to vary from the initial orientation. In addition, it has been observed that this swinging or swiveling of the containers may even allow the containers with the product to be irradiated to touch the X-ray tube when the containers swing or swivel in the direction toward the X-ray tube. As such, it has been determined that this variable distance between the container with the product being irradiated and the X-ray tube, and/or the touching of the container with the product being irradiated to the X-ray tube is not desired.

The instant disclosure of an irradiation apparatus with a limited swivel rotator is designed to address at least some aspects of the problems discussed above.

SUMMARY

Briefly described, in a possibly preferred embodiment, the present apparatus overcomes the above-mentioned disadvantages and meets the recognized need for such a device by providing an irradiation apparatus with a limited swivel rotator. The irradiation apparatus with the limited swivel rotator may generally include a drive ring and at least one mount affixed thereto. The drive ring may have a defined drive axis of rotation being configured to rotate about a source container, like a radiation source container or an X-ray tube. The mount or plurality of mounts may be affixed to the drive ring. Each of the mounts may be configured to mount a material holder to the drive ring for rotating the material holder about the source container. The limited swivel rotator may be in communication with each of the mounts and may be configured to maintain a radial planetary position of the mounts and the material holders mounted thereto to maintain an initial horizontal orientation of the mounts and the material holders mounted thereto on the drive ring as the mounts and the material holders mounted thereto are moved around the source container by the drive ring.

One feature of the instant disclosure may be that the limited swivel rotator may be configured to prevent any rotation of the mounts about a mounting axis and the material holders mounted thereto as the mounts and the material holders mounted thereto are moved around the source container by the drive ring.

Another feature of the instant disclosure may be that the limited swivel rotator may be configured to prevent any swinging, swiveling, or the like of the mounts and the material holders mounted thereto as the mounts and the material holders mounted thereto are moved in a circle around the source container by the drive ring.

Another feature of the instant disclosure may be that the limited swivel rotator may be configured to prevent the material holders from touching the source container as the mounts and the material holders mounted thereto are moved around the source container by the drive ring.

Another feature of the instant disclosure may be that the irradiation apparatus with the limited swivel rotator may be configured to transport the material holders evenly about the source container.

In one aspect, the limited swivel rotator may include a linkage system (cams, gears, the like, etc.) configured to maintain the radial planetary position of the mounts and the material holders mounted thereto to maintain the initial horizontal orientation of the mounts and the material holders mounted thereto on the drive ring as the mounts and the material holders mounted thereto are moved around the source container by the drive ring.

In select embodiments, the linkage system of the limited swivel rotator may include a guide plate in communication with the drive ring and the mounts mounted thereon. The guide plate may be configured to prevent the rotation of the mounts and the material holders mounted thereto as the mounts and the material holders mounted thereto are moved around the source container by the drive ring.

In other select embodiments, the linkage system of the limited swivel rotator may further include a cam link for each of the mounts. Each of the cam links may connect the drive ring and the mounts mounted thereon with the guide plate. The cam links may be configured to control the rotation of the mounts and the material holders mounted thereto via the guide plate to prevent any rotation of the mounts as the mounts and the material holders mounted thereto are moved around the source container by the drive ring.

In other select embodiments, the linkage system of the limited swivel rotator may further include a synchronizing ring. The synchronization ring may be connected to each cam link for synchronizing the movements of each cam link for each of the mounts and the material holder mounted thereto.

In select embodiments, each of the cam links may include a cam rotationally fixed between a mount shaft and a cam shaft. The mount shaft may be affixed to the mount through the drive ring. The cam shaft may include a cam shaft bearing positioned in a guide path in the guide plate. When the drive ring is rotated around the source, the cam link may force simultaneous movement of the cam shaft around the guide path to maintain the radial planetary position of the mounts and the material holders mounted thereto.

In select embodiments, each of the cam shafts may be mounted through the synchronization ring for synchronizing the movement of each of the mounts and the material holders mounted thereto.

In select embodiments, each of the mounts may include a mount bearing in a mount bearing housing positioned in the drive ring configured to allow rotation of the mount shaft and the material holder.

Another feature of the instant disclosure may be that the apparatus can be for providing X-ray energy to irradiate a product, where the source container is an X-ray tube.

BRIEF DESCRIPTION OF THE DRAWINGS

The present irradiation apparatus with limited swivel rotator will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-12, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
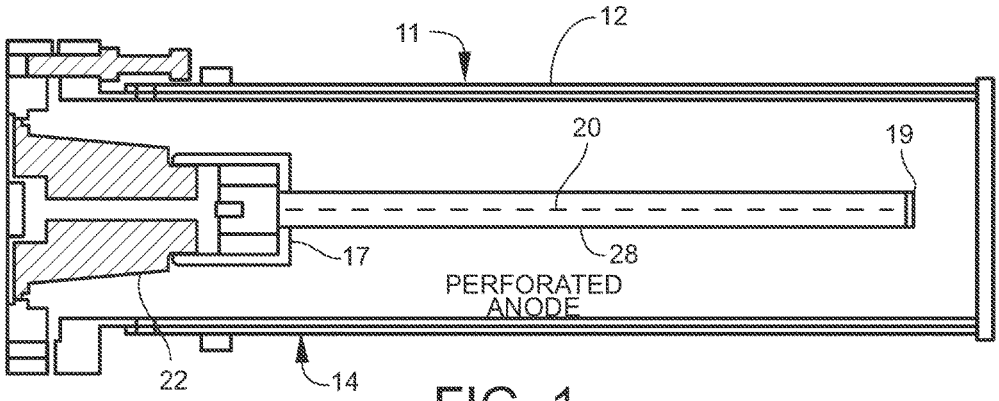
FIG. 1 Prior Art
FIG. 1 is a view of the X-Ray tube to show its elongated body according to the prior art.

Referring first to FIG. 1, a side view of the linear source of irradiation comprising X-Ray tube 11 is shown. This linear source of irradiation is the subject matter of the above cited U.S. Pat. No. 7,346,147, which is incorporated herein by reference. X-ray tube 11 has a cylindrical housing 12 and includes an elongated filament mounted within a perforated cylindrical and tubular anode 28. In the embodiment of the X-ray tube 11 in FIG. 1, the length of the tube is 17.2 inches in length and 4.5 inches in diameter. Power to the tube is provided through a high voltage connector 22. Tube 11 provides a linear, rather than a point source, of irradiation and a 4 pi/360 degree emission. The tube is cooled by means of a water jacket 14 encircling the housing 12.

Tube 11 provides a 4 pi/360 degree emission utilizing basic concepts disclosed in the above cited references. In addition to the concepts of a linear anode disclosed in U.S. publication No. 2007/0025515, reference is also made to U.S. Pat. No. 6,389,099 which discloses the concept of a radiation reflector. Reference is also made to U.S. Pat. No. 6,614,876 which discloses the concept of combining the radiation energy from multiple sources to irradiate a product as well as the concept of utilizing reflected photon energy from various surfaces to add to or combine with the direct radiation energy to provide enhanced irradiation. The linear tube 11, or X-ray tube 11 is a basic component of select embodiments of the apparatus of the disclosure, and method of use thereof, as will become clear.

Figure 2:
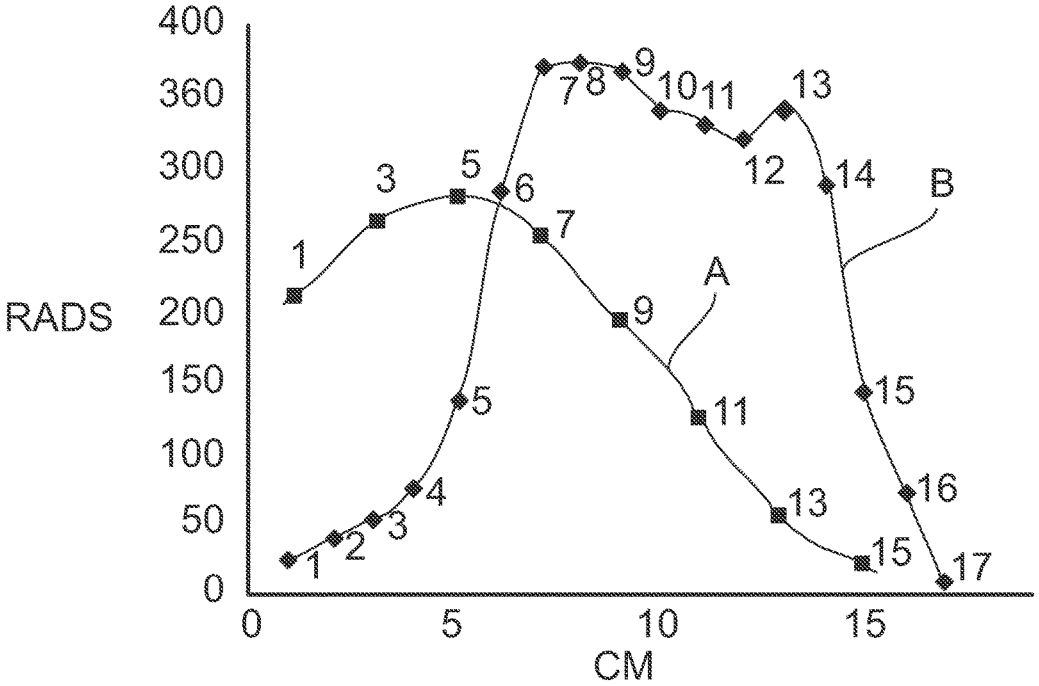
FIG. 2 Prior Art
FIG. 2 is a graph showing the uniform source of irradiation provided to the containers in accordance with the prior art.

The graph of FIG. 2 depicting RADS output on its vertical axis of abscissa and length in centimeters (CM) on its horizontal axis of ordinates, from the prior art of U.S. Pat. No. 7,346,147. The two plots in FIG. 2, line A and line B, depict the output of the X-ray tube 11 of FIG. 1 for two modifications of the X-ray tube to measure the dose peak and uniformity of output of the tube. Referring back to FIG. 1, it has been found empirically that the dose peak and uniformity are dependent on at least three factors; the size and shape of the face of support 17 holding the filament 20 (see FIG. 1), the diameter of the perforated anode 28, and the size and shape of the cap piece 19 on the distal end of the filament (see FIG. 1). It appears that the diameter and size of all three of the cited components contribute to shape the electron output of the tube and determine the field effect. The method and apparatus of the instant disclosure is designed to make this source of irradiation provided to the containers in accordance with the prior art even more uniform by limiting the swivel, swing, the like, etc. in the containers with the product.

Figure 3:
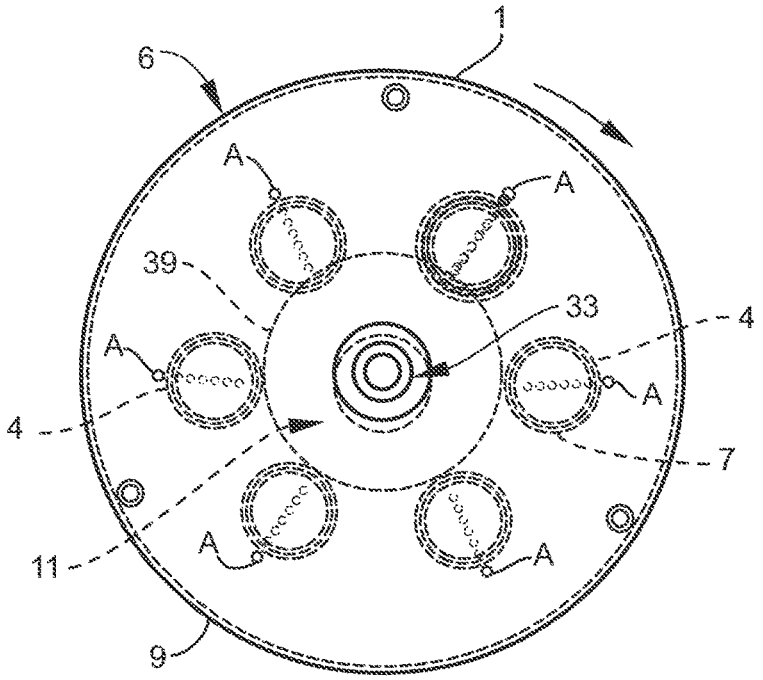
FIG. 3 Prior Art
FIG. 3 is a front view of the wheel structure and the free mounting or positioning of the X-Ray tube according to the prior art with free rotation in the mounting elements.
Figure 4:
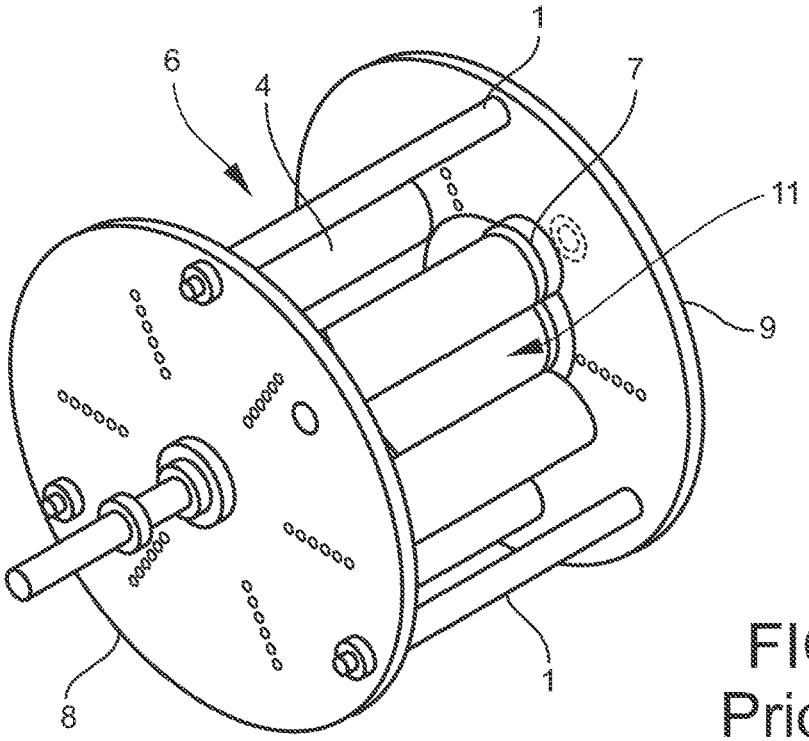
FIG. 4 Prior Art
FIG. 4 is a perspective view of the wheel structure and the free mounting or positioning of the X-Ray tube from FIG. 3 according to the prior art with free rotation in the mounting elements.
Figure 5:
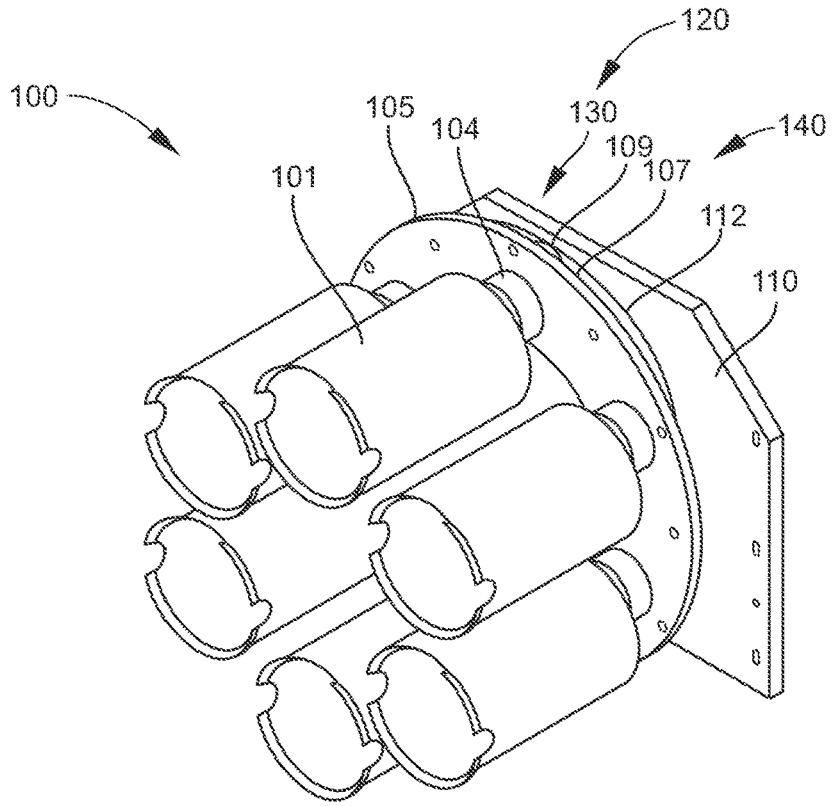
FIG. 5 is a schematic perspective view of the irradiation apparatus with the limited swivel rotator according to select embodiments of the instant disclosure.
Figure 6:
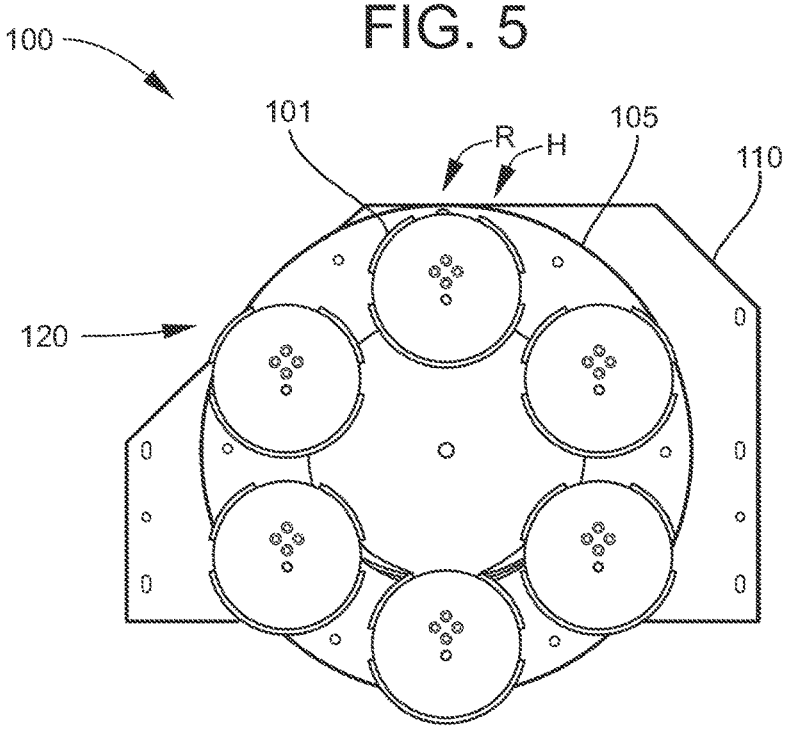
FIG. 6 is a schematic front view of the irradiation apparatus with the limited swivel rotator from FIG. 5.
Figure 7:
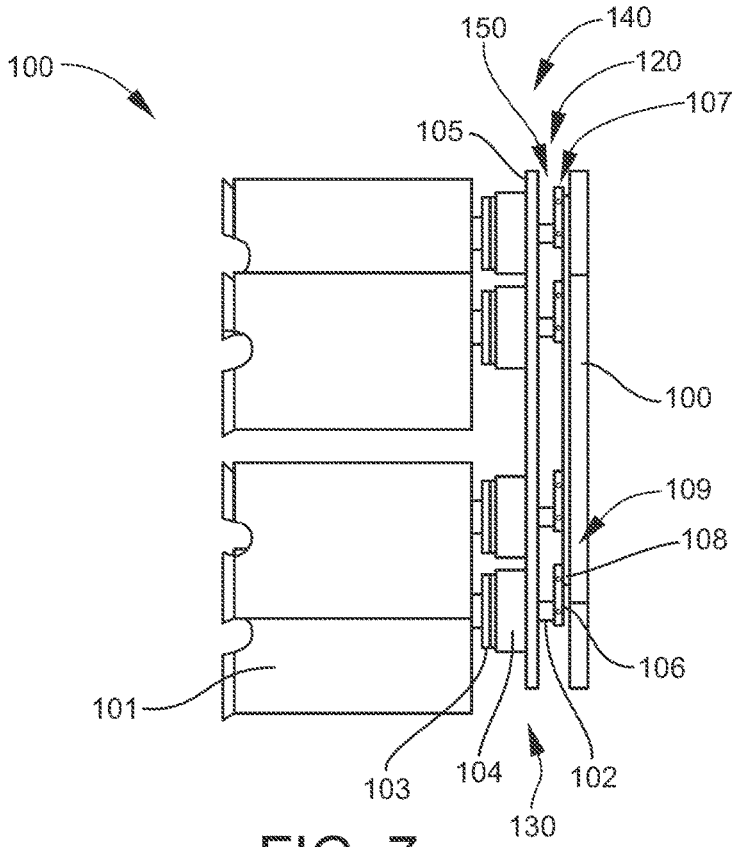
FIG. 7 is a schematic side view of the irradiation apparatus with the limited swivel rotator from FIG. 5.
Figure 8:
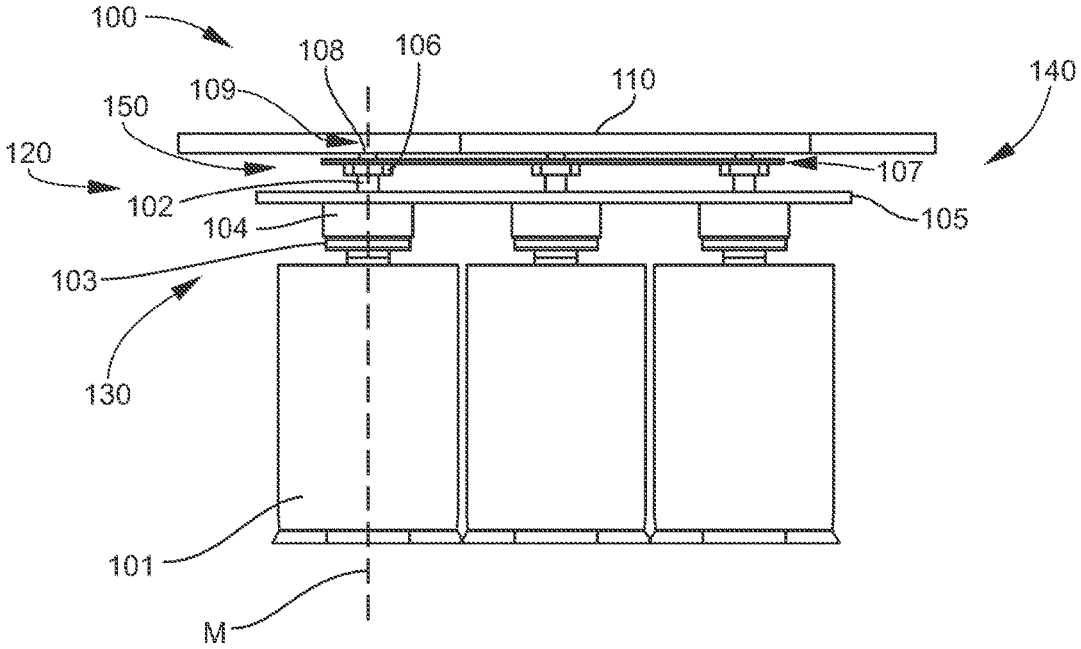
FIG. 8 is a schematic top view of the irradiation apparatus with the limited swivel rotator from FIG. 5.
Figure 9:
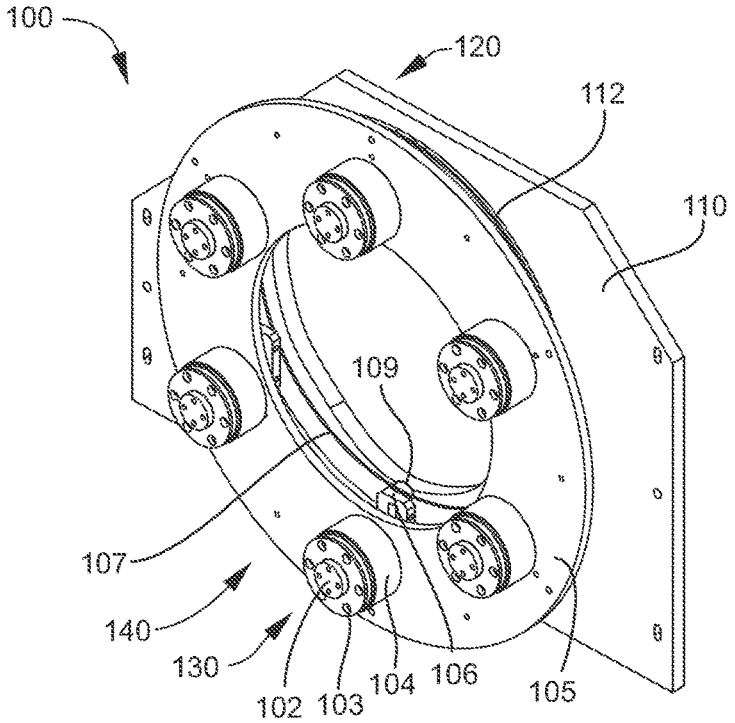
FIG. 9 is a schematic perspective view of the irradiation apparatus with the limited swivel rotator from FIG. 5 with the containers removed to reveal more of the limited swivel rotator.
Figure 10:
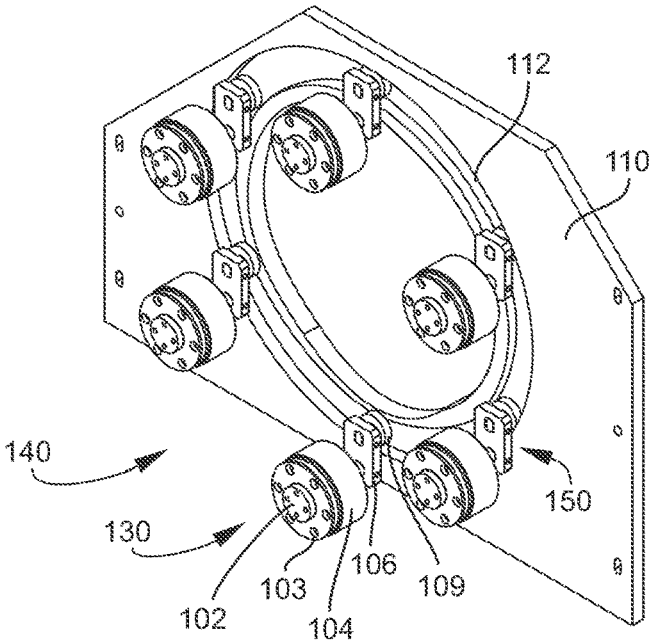
FIG. 10 is a schematic perspective view of the irradiation apparatus with the limited swivel rotator from FIG. 5 with the containers and the drive ring removed to reveal more of the limited swivel rotator.
Figure 11:
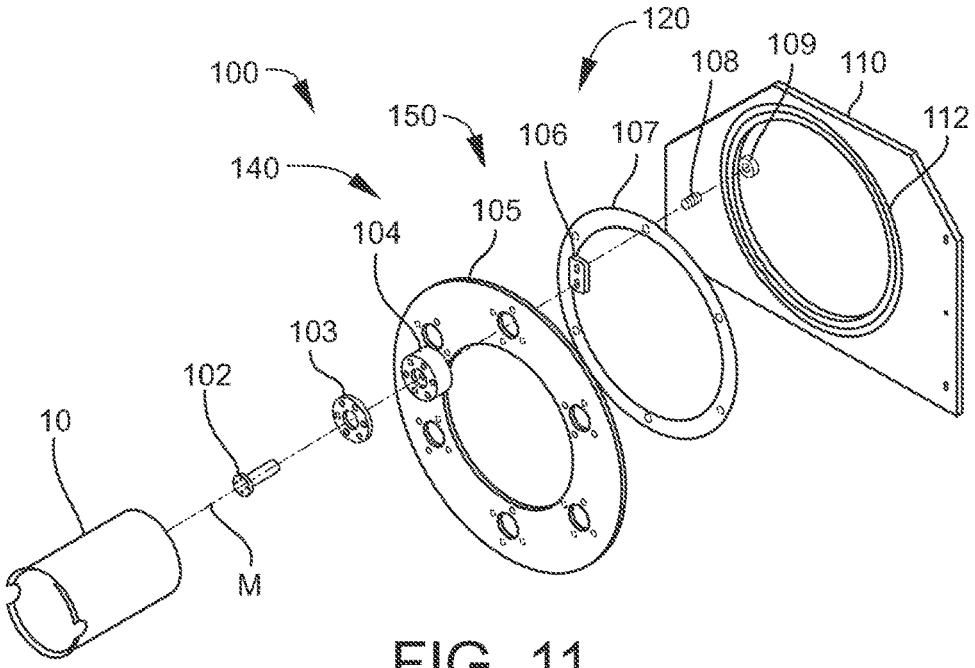
FIG. 11 is a perspective exploded view of the irradiation apparatus with the limited swivel rotator from FIG. 5 showing the limited swivel rotator connection of one container disassembled.
Figure 12:
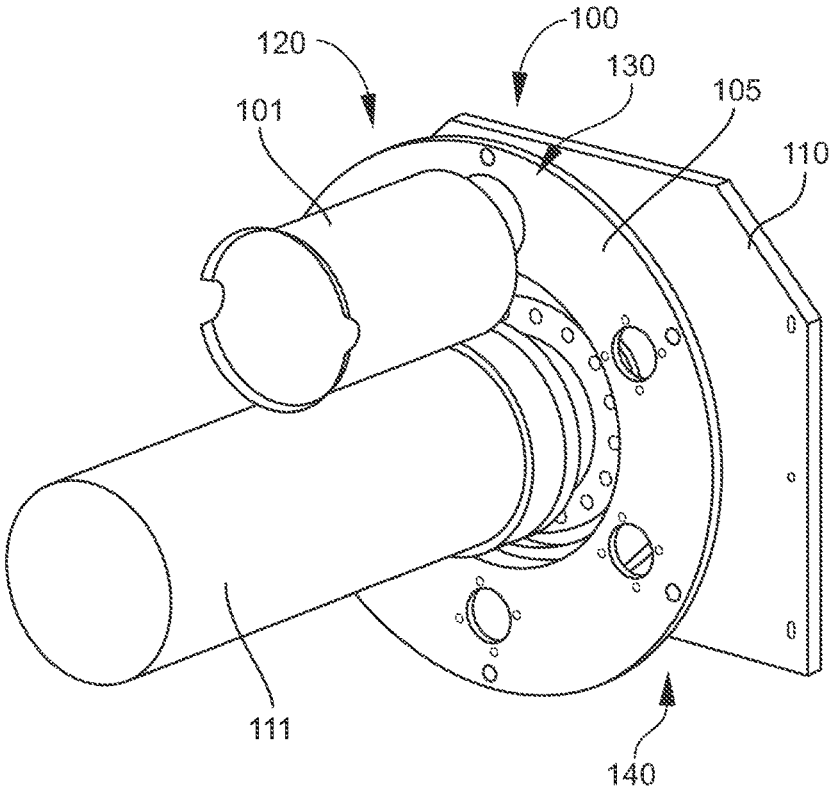
FIG. 12 is a schematic perspective view of the irradiation apparatus with the limited swivel rotator according to select embodiments of the instant disclosure with one container attached and the source inserted in the middle of the drive ring.

Referring now to FIGS. 3-4, these figures show the wheel structure and the free mounting or positioning of the X-Ray tube according to the prior art with free rotation in the mounting elements. This wheel structure with mounting that has free rotation in the mounting elements is the subject matter of the above cited U.S. Pat. No. 7,515,686, which is incorporated herein by reference. FIGS. 3 and 4 show the configuration of the wheel structure that includes a rotatable mechanism for carrying product which is to be irradiated by the X-Ray tube 11. Basically, the mechanism consists of a Ferris wheel type structure or system 6 having two spaced wheels 8 and 9 affixed to one another by braces or rods, generally labeled 1. The product to be irradiated is set or placed in containers 4. The embodiment of system 6 shown herein has six cylindrical containers 4. Each container is mounted on a respective cradle assembly 7. The cradle assemblies 7 are mounted in a spaced pattern between the wheels 8 and 9 and along the periphery of the wheels.

The mounting of the cradle assemblies 7 is similar to that of a well-known Ferris wheel; that is, each cradle 7 is swingably (the cradle can move back and forth as a swing about a mounting pivot pin) mounted on a horizontally extending axle (hung similarly to a Ferris wheel seat) so that the cradle center of gravity causes the cradle to maintain the similar orientation throughout its circular path around the periphery of the system. The cradle assemblies 7 are shaped to receive containers 4, which may be cylindrical in shape. The containers 4 carry (contain) the product or goods to be irradiated.

The X-ray tube 11 (tube housing 12) is mounted in a stationary position at the approximate center of the wheel structure 6 by a mechanical wheel and axle drive to enable the wheel structure 6 to rotate about the tube housing 12 mount. The passive mounting or distal end of the axle mounts wheel 9 to a suitable support. As can be appreciated, the axle drives the wheel 8 which in turn is connected through rods 1 to move wheel 9 which is mounted on a passive axle. High voltage power to the high voltage connector 22 of tube 11 is connected through known types of cables and insulating connectors.

As best seen in FIGS. 2 and 3, the cylindrically shaped X-Ray tube 11 is mounted slightly off center of the wheel axis, indicated by dashed line 33 in FIG. 3. The orientation of FIG. 3 shows the tube 11 which is axially mounted in its housing 12 to be off centered below the axis. In operation, product is placed inside the containers 4. The product in containers 4 receives the radiation energy from tube 11 and is set or placed in the container and should not tumble or revolve within the container 4 when the cradle 7 and wheels 8 and 9 rotate the container. Recall the similarity to a Ferris wheel wherein a person sits in the seat in an upright position, and even though the person is rotated on and by the wheel the seat assembly enables the person to remain in an upright position. Similarly in the prior art wheel structure, the container 4 is rotated by the wheels and is structured to retain its initial orientation to also retain the product in its initial orientation and position.

However, because the container 4 is mounted to retain it's initial orientation the container seat does not move in an exact circle. The seat wobbles in its rotation, and is closer to the axis of the wheel when it is above the axis and further from the axis when it is below the axis. In FIG. 3, note the axis labeled 33 and the imaginary dotted circle labeled 39 about the axis 33. By reference to circle 39 it can be seen that the cradles 7 carrying the containers 4 rotate in a wobbling manner about circle 39.

A well-known principle in X-ray technology is that radiation energy is related to the distance between the X-ray source and the product receiving the energy. (Assume for purposes of the following explanation that FIG. 3 represents a clock face). In the prior art wheel structure 6, the side (say bottom side) of each of the containers 4 is closest to the tube 11 when the container is at its highest position (12 o'clock position) and receives the most radiation energy from the tube. In contrast, the other side (say top side) of each container receives the least radiation when the container is at its lowest position (6 o'clock position). This action would continue throughout each cycle for each of the containers.

As such, the prior art wheel structure of U.S. Pat. No. 7,515,686, as shown in FIGS. 3-4 is designed to provide an apparatus to assure that a uniform irradiation is provided to all of the product in each container. Refer now mainly to FIG. 3. In operation, as the carousel 6 is rotated, the containers 4 (cylinders) are moved about the axis of rotation 33. As the containers 4 are moved around axis 33 the side of each of the containers 4 facing the tube 11 changes. Note in FIG. 3, an imaginary dot "A" painted on the container 4 (for present explanation purposes) at the one o'clock position points upwardly to the right. As the container 4 is rotated clockwise by the wheels, to the three o'clock position, the dot "A" points to the right; at the five o'clock position, the dot "A" points downwardly to the right. As the container continues to rotate, to the 11 o'clock position the imaginary dot "A" is rotated almost back to its initial position. Note, of course that there are six containers 4, all of which are moving concurrently and that the above explanation is applicable to each container as it moves about its circle.

In FIG. 3, the axis of the wheels is labeled as 33, the stationary position of the X-ray tube 11 is indicated by imaginary dotted line circle 11, and wheels 8 and 9 move around the tube. If the tube were to be mounted on the axis 33 of the wheels, the distance between the tube 11 and each of the containers 4 would vary as the containers move around the tube. This is clearly indicated by the overlapping of the dotted line 39 by containers at the one o'clock position and at the eleven o'clock position. If the tube 11 were mounted along the axis of the wheel, a higher amount of radiation energy would impinge on one side of the container 4, mounted at the relative axis of the wheels simply because it is closer to the tube at that position.

U.S. Pat. No. 7,515,686 discloses that a more uniform irradiation from the X-Ray tube 11 to the product in each of the containers 4 is obtained by mounting the tube 11 in a position that is offset from the axis of the wheels 8 and 9. This feature is also indicated in FIG. 3 by the dotted circle labeled 11, that depicts the relative position of the tube. The distance that the containers 4 moved downwardly relative to the circle 39 can be calculated, or the axis 33 can be empirically determined. The tube is mounted in position, and offset downwardly from the axis 33 to compensate for the amount of variation in the relative position of a container in the twelve o'clock position and a container in the six o'clock position. The purpose, of course, is an attempt to maintain the distance of the containers from the X-Ray tube 11 relatively constant as each container is moved on by its cradle affixed to wheels 8 and 9.

One problem that has been discovered with this free rotation mounting elements or cradle assemblies 7 for the containers 4 in U.S. Pat. No. 7,515,686, that utilize gravity like a Ferris wheel for maintaining the initial horizontal orientation, as shown in FIGS. 2-3, is that they allow for swinging or swiveling of the containers 4. This swinging or swiveling of the containers 4 permits the distance from the container 4 to the X-ray tube 11 to vary from the initial orientation. In addition, it has been observed that this swinging or swiveling of the containers 4 may even allow the containers 4 with the product to be irradiated to touch the X-ray tube 11 when the containers 4 swing or swivel in the direction toward the X-ray tube 11. As such, it has been determined that this variable distance between the containers 4 with the product being irradiated and the X-ray tube 11, and/or the touching of the containers 4 with the product being irradiated to the X-ray tube is not desired.

Referring now to FIGS. 5-13, the instant disclosure of irradiation apparatus 100 with limited swivel rotator 120 is designed to eliminate or at least restrict the swinging or swiveling of the containers. As such, the instant disclosure of irradiation apparatus 100 with limited swivel rotator 120 is designed to keep the distance constant (or approximately constant) between the container with the product to be irradiated (material holders 101) and the source container 111 (see FIG. 12), like a radiation source or X-ray tube. In addition, the instant disclosure of irradiation apparatus 100 with limited swivel rotator 120 is designed to prevent the containers with the product to be irradiated (material holders 101) and the source container 111 from touching. The instant disclosure of irradiation apparatus 100 with limited swivel rotator 120 is designed to orient the containers similar to that of U.S. Pat. No. 7,515,686, as shown in FIGS. 3-4 and discussed above. However, instead of having free rotation mounting elements of the containers 4, that utilize gravity like a Ferris wheel for maintaining the initial horizontal orientation, like cradles 7 shown in FIGS. 3-4, the instant disclosure provides a mechanism that fixes the orientation for the containers with product to be irradiated (material holders 101) via the limited swivel rotator 120, as discussed in detail below. As such, the containers or material holders 101 can be positioned closer to the radiation source or X-ray tube for more efficient irradiation.

Referring now to FIGS. 5-12 by way of example, and not limitation, therein is illustrated example embodiments of irradiation apparatus 100 with limited swivel rotator 120. Irradiation apparatus 100 may be for irradiating products in material holders 101, like medical, industrial, food, the like, etc., similar to that disclosed in U.S. Pat. No. 7,515,686. As such, irradiation apparatus 100 can be for providing X-ray energy to irradiate a product. Irradiation apparatus 100 may generally include drive ring 105 and at least one mount 130 affixed thereto. Drive ring 105 may have a defined drive axis of rotation being configured to rotate about an X-ray tube. Mounts 130 may be affixed to drive ring 105. Each of the mounts 130 may be configured to mount a material holder 101 to drive ring 105 for rotating about the source container 111. The limited swivel rotator 120 may be in communication with each of the mounts 130 to maintain radial planetary position of the mounts 130 and the material holders 101 mounted thereto. This radial planetary position is labeled as R in FIG. 6, and is similar to the A positions shown in FIG. 3 from the prior art in U.S. Pat. No. 7,515,686. In other words, limited swivel rotator 120 may maintain an initial horizontal orientation of the mounts 130 and the material holders 101 mounted thereto on the drive ring 105 as the mounts 130 and the material holders 101 mounted thereto are moved around the source container 111 by the drive ring 105. This initial horizontal orientation is labeled as H in FIG. 6.

One feature of the instant disclosure may be that the limited swivel rotator 120 of the irradiation apparatus 100 may be configured to prevent any rotation of the mounts 130 about mounting axis M of each mount 130 and the material holders 101 mounted thereto as the mounts 130 and the material holders 101 mounted thereto are moved around the source container 111 by the drive ring 105.

Another feature of the instant disclosure may be that the limited swivel rotator 120 may be configured to prevent any swinging, swiveling, or the like, of the mounts 130 and the material holders 101 mounted thereto as the mounts 130 and the material holders 101 mounted thereto are moved in a circle around the source container 111 by the drive ring 105.

Another feature of the instant disclosure may be that the limited swivel rotator 120 may be configured to prevent the material holders 101 from touching the source container 111 as the mounts 130 and the material holders 101 mounted thereto are moved around the source container 111 by the drive ring 105.

In select embodiments of the instant disclosure, the limited swivel rotator 120 of the irradiation apparatus 100 may be configured to: prevent any swinging or swiveling of the mounts 130 and the material holders 101 mounted thereto as the mounts 130 and the material holders 101 mounted thereto are moved in a circle around the source container 111 by the drive ring 105; and prevent the material holders 101 from touching the source container 111 as the mounts 130 and the material holders 101 mounted thereto are moved around the source container 111 by the drive ring 105.

Another feature of the instant disclosure may be that the apparatus 100 may be configured to transport the material holders 101 evenly about the source container 111.

The limited swivel rotator 120 may include linkage system 140 configured to maintain the radial planetary position R of the mounts 130 and the material holders 101 mounted thereto to maintain the initial horizontal orientation H of the mounts 130 and the material holders 101 mounted thereto on the drive ring 105 as the mounts 130 and the material holders 101 mounted thereto are moved around the source container 111 by the drive ring 105. Linkage system 140 may include any devices, components, members, the like, or configurations thereof, for maintaining the radial planetary position R of the mounts 130 and the material holders 101 mounted thereto to maintain the initial horizontal orientation H of the mounts 130 and the material holders 101 mounted thereto on the drive ring 105 as the mounts 130 and the material holders 101 mounted thereto are moved around the source container 111 by the drive ring 105. For example, linkage system 140 may include any cams, gears, drives, bands, pulleys, the like, combinations thereof, etc.

Referring now specifically to the embodiments shown in FIGS. 5-12, linkage system 140 of the limited swivel rotator 120 may include guide plate 110. Guide plate 110 may be in communication with drive ring 105 and the mounts 130 mounted thereon. Guide plate 110 may be configured to prevent the rotation of the mounts 130 and the material holders 101 mounted thereto as the mounts 130 and the material holders 101 mounted thereto are moved around the source container 111 by the drive ring 105. Guide plate 110 may include guide path 112 for controlling the rotation of mounts 130 and the material holders 101 mounted thereto as the mounts 130 and the material holders 101 mounted thereto are moved around the source container 111 by the drive ring 105. Guide path 112 may be a channel, track, protrusion, embossment, the like, etc. configured to control the rotation of mounts 130 and the material holders 101 mounted thereto as the mounts 130 and the material holders 101 mounted thereto are moved around the source container 111 by the drive ring 105.

A cam link 150 may be included in linkage system 140 of limited swivel rotator 120 for each of the mounts 130. Each of the cam links 150 may connect the drive ring 105 and the mounts 130 mounted thereon with the guide plate 110. The cam links 150 may be configured to control the rotation of the mounts 130 and the material holders 101 mounted thereto via the guide plate 110 to prevent any rotation of the mounts 130 as the mounts 130 and the material holders 101 mounted thereto are moved around the source container 111 by the drive ring 105.

A synchronizing ring 107 may be included in linkage system 140 of limited swivel rotator 120. The synchronization ring 107 may be connected to each cam link 150 for synchronizing the movements of each cam link 150 for each of the mounts 130 and the material holder 101 mounted thereto.

A cam 106 may be included in linkage system 140 of limited swivel rotator 120 for each of the cam links 150. Each cam 106 may be rotationally fixed between a mount shaft 102 and a cam shaft 108. The mount shaft 102 may be affixed to the mount 130 through the drive ring 105. The cam shaft 108 may include a cam shaft bearing 109 positioned in the guide path 112 in the guide plate 110. When the drive ring 105 is rotated around the source container 111, the cam 106 may force simultaneous movement of the cam shaft 108 around the guide path 112 of the guide plate 110 to maintain the radial planetary position R of the mounts 130 and the material holders 101 mounted thereto. In select embodiments, each of the cam shafts 108 may be mounted through the synchronization ring 107 equal distance from each other for synchronizing the movement of each of the mounts 130 and the material holders 101 mounted thereto.

A mount bearing 103 may be included in each of the mounts 130. The mount bearings 103 may be positioned in a mount bearing housing 104. Each of the mount bearing housings 104 may be positioned in the drive ring 105 and may be configured to allow rotation of the mount shaft 102 and thus the material holder 101.

In use, apparatus 100 with limited swivel rotator 120 and methods of use thereof may be for material irradiation, Apparatus 100 may be a transport device or transport system to transport material or product in material holder 101 proximate the source container 111, like in an X-ray tube. The components described above and shown in FIGS. 5-12 of apparatus 100 may integrally be configured to transport material holder 101 about source container 111. It is contemplated herein that source container 111, or the X-ray tube, may be replaced with other applicators such as paint applicator to paint several items positioned such as material holder 101, heat source to heat several items positioned such as material holder 101, such as material or food, and the like.

When constructing or manufacturing, apparatus 100 with limited swivel rotator 120 may be oriented so that guide plate 110 may be approximately perpendicular to the ground or surface. Drive ring 105 preferably turns so that the material holders 101 are moved or rotated about the source container 111. The horizontal diameter of each material holder 101 may preferably remain approximately parallel to the ground as each material holder 101 is rotated around Source container 111, thereby exposing its entire outer circumference once in a single rotation of the drive ring 105 to radiation from source container 111. Possibly preferably, each of the mount shafts 102 may be attached or removeably affixed to each of the mount bearings 103, which may be preferably attached or removeably affixed to mount bearing housing 104 (or it may be mounted directly to drive ring 105) so that each mount shaft 102 passes through drive ring 105. Furthermore, each material holder 101 may be preferably attached or removeably affixed to each mount shaft 102. Mount shaft 102 may be preferably attached or removeably affixed to the cam 106. In use, as drive ring 105 may be rotated, cam shaft bearing 109 (attached or removeably affixed to the cam shaft 108) may be preferably guided by the guide path 112 in the guide plate 110 either by a channel in the guide plate 110 in which the cam shaft bearing 109 travels or by an embossment or protrusion on the guide plate 110 around or within which the cam shaft bearing 109 travels. Possibly preferably, synchronizing ring 107 may include holes placed equidistantly so that when the ring 107 may be mounted on cam shafts 108 the distance between cam shafts 108 is constantly held equal.

Possibly preferably, apparatus 100 with limited swivel rotator 120, and methods of use thereof, operate to mitigate swivel of material holder 101 by limiting the rotation of mount shaft 102 when drive ring 105 is in one position, a first position. This is accomplished by limiting the movement of all of cam shafts 108 via the combination of synchronizing ring 107 locking the distances between all of the cam shafts 108 so that when the cam shaft bearings 109 of even one cam shaft's 108 movement is limited by the guide plate 110 (whether via the channel or embossment), all of the cam shafts 108 movement are limited, which cause the limitation of swivel by any of mount shafts 102 and thus the material holders 101.

Accordingly, a feature of the instant apparatus and method for rotating material around an irradiation source (e.g. X-ray tube) is its ability to limit the material, material holders' or subassembly (the "material holder") swivel motion wherein material or material holder maintains its non-planetary movement about the irradiation source (i.e., the material holder does not spin about its axis in the same plane and the actual motion is similar to a Ferris wheel car).

Accordingly, a feature of the instant apparatus and methods with limited swivel rotator is that the material holder is mounted wherein the mount point on material holder is preferably not centered but offset to allow gravity to first maintain material holders' non-planetary movement about the irradiation source, this system and method mitigates the possibility of material holder coming into contact with the irradiation source in the event material holder were to swing.

Accordingly, a feature of the instant apparatus with limited swivel rotator, and methods of use thereof, is that the material holder may be mounted wherein the mount point on material holder is preferably centered, this system and method mitigates the possibility of material holder rotating on its own axis.

It is contemplated herein that the "offset" configuration eliminates significant rotation about the material holder's axis AND it eliminates possibility of material holder touching the source container. With the "centered, non-offset" mount, it eliminates significant rotation about the material holder's axis (but since material holder is center mounted, it already could not touch the source container since there is no "swing distance".

Accordingly, a feature of the system and methods of limited swivel rotator is that the surface of the material holder can be kept close to the source throughout its movement about the source but mitigate the possibility that, while in rotation about the source, material holder will come in contact with the source.

Accordingly, a feature of the instant apparatus with limited swivel rotator, and methods of use thereof, may be its ability to limit each material holder from swiveling, rotating on its own axis.

Another feature of the instant apparatus with limited swivel rotator, and methods of use thereof, may be its ability to prevent each material holder from touching the source container, like an x-ray tube.

Yet another feature of the instant apparatus with limited swivel rotator, and methods of use thereof, may be its ability to reduce the variance of radiation received throughout the material within the material holder.

Yet another feature of the instant apparatus with limited swivel rotator, and methods of use thereof, may be its ability to perform bulk material irradiation or sterilization.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. An irradiation apparatus comprising:

a drive ring having a defined drive axis of rotation to rotate about a source container;

at least one mount affixed to said drive ring, each of said mounts is configured to mount a material holder to said drive ring for rotating the material holder about the source container; and a limited swivel rotator in communication with each of the mounts configured to maintain a radial planetary position of said mounts and said material holders mounted thereto to maintain an initial horizontal orientation of said mounts and said material holders mounted thereto on said drive ring as said mounts and said material holders mounted thereto are moved around said source container by said drive ring.

2. The irradiation apparatus of claim 1, wherein the limited swivel rotator is configured to prevent rotation of said mounts about a mounting axis and said material holders mounted thereto as said mounts and said material holders mounted thereto are moved around said source container by said drive ring.

3. The irradiation apparatus of claim 1, wherein the limited swivel rotator is configured to prevent any swinging or swiveling of said mounts and said material holders mounted thereto as said mounts and said material holders mounted thereto are moved around said source container by said drive ring.

4. The irradiation apparatus of claim 1, wherein the limited swivel rotator prevents said material holders from touching the source container as said mounts and said material holders mounted thereto are moved around said source container by said drive ring.

5. The irradiation apparatus of claim 1, wherein the limited swivel rotator is configured to:

prevent any swinging or swiveling of said mounts and said material holders mounted thereto as said mounts and said material holders mounted thereto are moved around said source container by said drive ring; and prevent said material holders from touching the source container as said mounts and said material holders mounted thereto are moved around said source container by said drive ring.

6. The irradiation apparatus of claim 1 being configured to transport the material holders evenly about the source container.

7. The irradiation apparatus of claim 1, wherein the limited swivel rotator comprises a linkage system configured to maintain the radial planetary position of said mounts and said material holders mounted thereto to maintain the initial horizontal orientation of said mounts and said material holders mounted thereto on said drive ring as said mounts and said material holders mounted thereto are moved around said source container by said drive ring.

8. The irradiation apparatus of claim 7, wherein the linkage system of the limited swivel rotator comprises:

a guide plate in communication with said drive ring and said mounts mounted thereon;

wherein, said guide plate prevents the rotation of the mounts and the material holders mounted thereto as said mounts and said material holders mounted thereto are moved around said source container by said drive ring.

9. The irradiation apparatus of claim 8, wherein the linkage system of the limited swivel rotator further comprises:

a cam link for each of said mounts, each of said cam links connects said drive ring and said mounts mounted thereon with said guide plate;

wherein, said cam links are configured to control rotation of the mounts and the material holders mounted thereto via said guide plate to prevent any rotation of the mounts as said mounts and said material holders mounted thereto are moved around said source container by said drive ring.

10. The irradiation apparatus of claim 9, wherein the linkage system of the limited swivel rotator further comprising a synchronizing ring, said synchronizing ring being connected to each cam link for synchronizing movements of each cam link for each of the mounts and the material holder mounted thereto.

11. The irradiation apparatus of claim 10, wherein each of the cam links comprising:

a cam rotationally fixed between a mount shaft and a cam shaft;

said mount shaft is affixed to the mount through said drive ring;

said cam shaft includes a cam shaft bearing positioned in a guide path in said guide plate;

whereby, when said drive ring is rotated around the source container, the cam link forces simultaneous movement of said cam shaft around the guide path to maintain the radial planetary position of said mounts and said material holders mounted thereto.

12. The irradiation apparatus of claim 11, wherein each of the cam shafts are mounted through the synchronizing ring for synchronizing the movement of each of the mounts and the material holder mounted thereto.

13. The irradiation apparatus of claim 1, wherein each mount including:

a mount bearing in a mount bearing housing positioned in said drive ring configured to allow rotation of a mount shaft with the material holder.

14. The irradiation apparatus of claim 1, wherein the apparatus is for providing X-ray energy to irradiate a product.

15. A limited swivel rotator for an irradiation apparatus with a drive ring and at least one mount for a material holder affixed to said drive ring for rotating the material holder about a source container, said limited swivel rotator being in communication with each of the mounts configured to maintain a radial planetary position of said mounts and said material holders mounted thereto to maintain an initial horizontal orientation of said mounts and said material holders mounted thereto on said drive ring as said mounts and said material holders mounted thereto are moved around said source container by said drive ring.

16. The limited swivel rotator of claim 15 being configured to:

prevent any rotation of said mounts about a mounting axis and said material holders mounted thereto as said mounts and said material holders mounted thereto are moved around said source container by said drive ring;

prevent any swinging or swiveling of said mounts and said material holders mounted thereto as said mounts and said material holders mounted thereto are moved around said source container by said drive ring;

prevent said material holders from touching the source container as said mounts and said material holders mounted thereto are moved around said source container by said drive ring; and/or transport the material holders evenly about the source container.

17. The limited swivel rotator of claim 15, wherein the limited swivel rotator comprises a linkage system configured to maintain the radial planetary position of said mounts and said material holders mounted thereto to maintain the initial horizontal orientation of said mounts and said material holders mounted thereto on said drive ring as said mounts and said material holders mounted thereto are moved around said source container by said drive ring.

18. The limited swivel rotator of claim 17, wherein the linkage system of the limited swivel rotator comprises:

a guide plate in communication with said drive ring and said mounts mounted thereon;

a cam link for each of said mounts, each of said cam links connects said drive ring and said mounts mounted thereon with said guide plate;

each of the cam links comprising:

a cam rotationally fixed between a mount shaft and a cam shaft;

said mount shaft is affixed to the mount through said drive ring;

said cam shaft includes a cam shaft bearing positioned in a guide path in said guide plate;

whereby, when said drive ring is rotated around the source container, the cam link forces simultaneous movement of said cam shaft around the guide path to maintain the radial planetary position of said mounts and said material holders mounted thereto;

a synchronizing ring with each of the cam shafts connected there through, said synchronizing ring via the connection to each cam link synchronizing the movements of each cam link for each of the mounts and the material holder mounted thereto, for synchronizing the movement of each of the mounts and the material holder mounted thereto.

19. The limited swivel rotator of claim 15, wherein each mount including:

a mount bearing and a mount bearing housing configured to allow rotation of a mount shaft and the material holder.

20. The limited swivel rotator of claim 15, wherein the apparatus is for providing X-ray energy to irradiate a product.

* * * * *